US005325997A

United States Patent [19]

Washington, Kenneth E. et al.

[11] Patent Number: 5,325,997

[45] Date of Patent: Jul. 5, 1994

[54] COMBINED HAND WEIGHT AND PROTECTIVE SPRAY DEVICE

[76] Inventors: Washington, Kenneth E., 532 Summit Ridge Dr., Chesapeake, Va. 23320; Larry E. Washington, 880 S. Spigel Dr., Virginia Beach, Va. 23454

[21] Appl. No.: 90,236

[22] Filed: Jul. 13, 1993

[51] Int. Cl.[5] ..... B67D 5/64

[52] U.S. Cl. ..... 222/175; 222/192; 482/108

[58] Field of Search ..... 222/78, 175, 192; D9/378; 42/1.04; 482/106-108

[56] References Cited

U.S. PATENT DOCUMENTS

| | | | |
|---|---|---|---|
| 2,634,535 | 4/1953 | Borders | 42/1.04 |
| 3,432,077 | 3/1969 | Voll | 222/78 |
| 3,516,424 | 6/1970 | Eagle | 222/192 X |
| 4,218,057 | 8/1980 | Wilson . | |
| 4,229,015 | 10/1980 | Ramsey et al. | 222/552 X |
| 4,351,526 | 9/1982 | Schwartz . | |
| 4,463,879 | 8/1984 | Des Voignes | 222/175 |
| 4,575,074 | 3/1986 | Damratoski . | |
| 4,702,473 | 10/1987 | Paquette | 222/175 X |
| 4,720,098 | 1/1988 | Gordon | 206/315.1 X |
| 5,111,968 | 5/1992 | Wilkerson | 222/175 X |

*Primary Examiner*—Andres Kashnikow
*Assistant Examiner*—Kenneth DeRosa
*Attorney, Agent, or Firm*—John B. Dickman, III

[57] ABSTRACT

A hand weight and attack repellent combination device including a handle with a covering, said handle having a strap and a threaded end to receive a removable weight and a container receiving end. An attack repellent container of standard size is used for placement in the container receiving end.

6 Claims, 1 Drawing Sheet

COMBINED HAND WEIGHT AND PROTECTIVE SPRAY DEVICE

BACKGROUND OF THE INVENTION

The present invention relates to walkers and joggers who carry hand weights or dumbbells and are concerned about the rising violence of criminal assault, robbery or rape. The field of invention is hand weights with attack repelling apparatus and more particularly to hand weights with a repellent spray container holding means.

It is well known to use small pressurized hand held canisters containing attack repellent such as tear gas, mace, cayenne pepper spray or some other repellent. One of the most recent U.S. Patents is U.S. Pat. No. 4,463,879, issued to Des Voegnes and is set forth in the disclosure, a canister is carried in a user's hand for immediate access and use. The repellent device is attached to a hand by an elastic strap, and cannot easily be dropped or even pried from the hand. The Des Voegnes device also permits use of the repellent even if both hands are pinned or held. The victim need only have use of his or her fingers of the hand carrying the device. The device can be armed, pinned and actuated with the carrying arm pinned. There is a container with a rotatable actuator cap which rotates from a locked to an operational position. The thrust of the Des Voegnes patent is directed to the holder for the repellent container.

Hand weights or dumbbells are also well known. Typically they have a handle with weights on both ends. One such hand weight is disclosed in U.S. Pat. No. 4,351,526, issued to Swartz. According to the disclosure, the hand weight has a rigid handle with a soft, resilient outer covering. The ends of the handle are threaded to receive removable weights of different sizes. Fitted on the threaded ends is a hand strap to secure the hand weight on a persons hand.

The present invention is an improvement on the Swartz patent, by providing an attack repellent container in a hand weight. Until the present invention, walkers and joggers carried separate attack repellent containers, such as the Des Voegnes holder, whistles, of some other alarm device. Naturally, trying to carry some type of repellent while walking or jogging with hand weights is very difficult. In fact it becomes next to impossible to use the repellent without dropping the hand weights.

The present invention permits a walker or jogger to exercise with the security of having an attack repellent ready to use on a moments notice.

There is no special effort required to hold the hand weights in a particular manner since there is a strap which aligns the hand weights with the attack repellent container facing away from the walker or jogger and in the direction of a person facing the walker or jogger.

SUMMARY OF THE INVENTION

The hand weight and attack repellent of the invention generally includes a cylindrical hand portion, a threaded end at one end of the hand portion. The hand portion is covered with a soft, resilient member to better grip the hand portion. A hand engaging strap with a soft, resilient material with apertures on the ends to fit on the cylindrical hand portion. The threaded end of the hand portion receives removable weights of different sizes. The opposite end of the hand portion has a hollow tube-like structure which extends to a blind end in the hand portion.

The hollow tube-like structure can be partially filled with lead or other material to add or subtract weight to the hand held weight. Above the blind portion is an attack repellent container receiving hollow tube-like aperture. An integral collar on the hollow tube-like end has a set screw to engage the container and hold it in place. This structure permits the walker's or jogger's hand to be relaxed during walking or jogging, while having an attack repellent ready to use.

DESCRIPTION OF THE INVENTION

Figure 1:
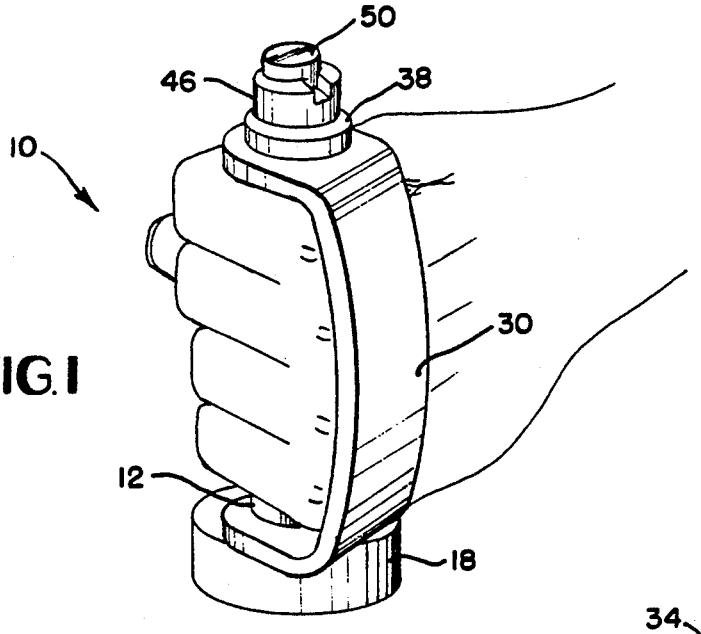
FIG. 1 is an isometric view of a hand weight and attack repellent combination of the invention.
Figure 3:
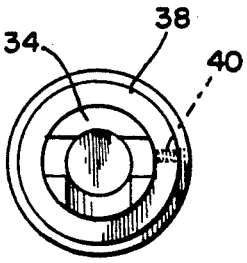
FIG. 3 is a top view of a hand weight and attack repellent combination.
Figure 2:
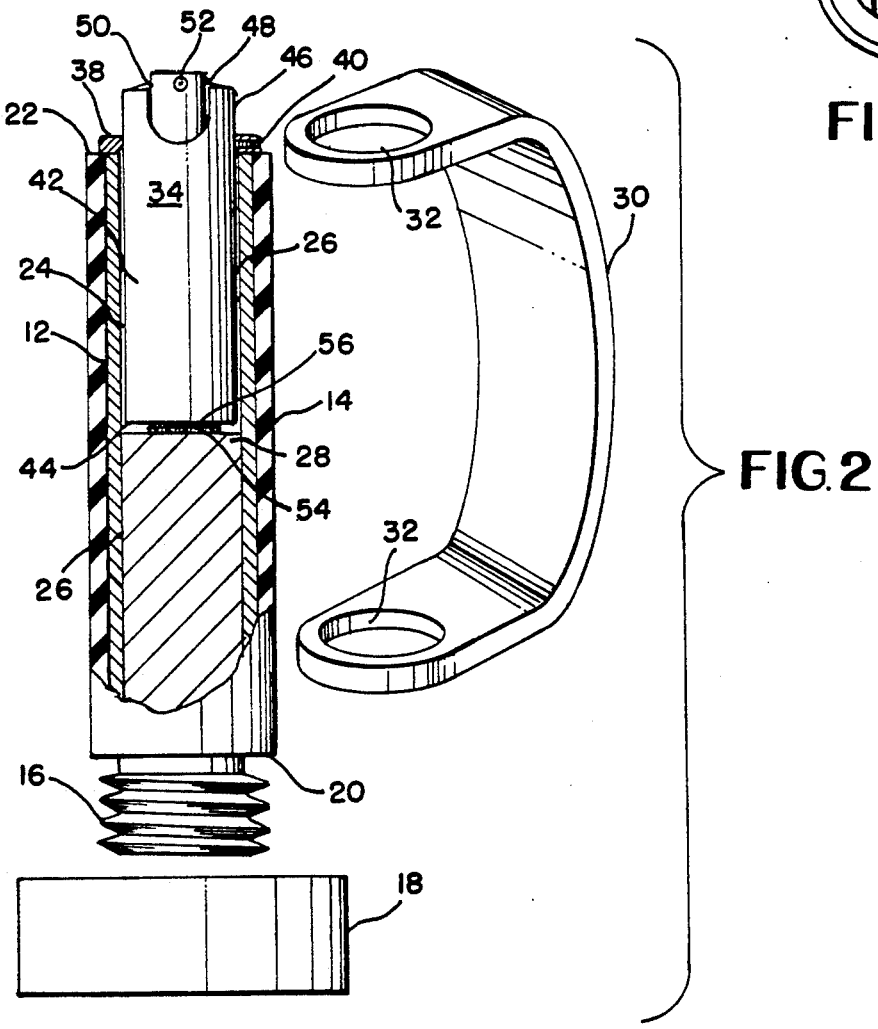
FIG. 2 is a partial cut-away view of a hand weight and attack repellent combination.

Referring to the drawings, there is illustrated in FIGS. 1 and 2 a hand weight and attack repellent combination device 10 of the invention. There is a handle portion 12 covered with a soft, resilient member 14. One end 20 of handle portion 12 has threads 16 for receiving and securing a removable weight 18. Removable weight 18 represents weights of different sizes to provide different levels of exercise.

The other end 22 of handle portion 12 has a hollow tubelike aperture 24 and extends to a blind end, not shown, material 26 is a part of or inserted in the hollow tube-like aperture 24 to half fill the aperture. The remaining portion of the aperture 24 is a container receiving section 26 with the top of the material 28 being the bottom of section 26.

A hand strap 30 with apertures 32 slip over the ends 20 and 22 of the handle portion 12 to provide a secure grip of the hand weights. Handle 30 is made of a soft, resilient rubber of plastic, or a flexible material with a padded surface. Apertures 32 are slipped over the ends 20 and 22 and pressed into frictional engagement with handle portion 12.

An attack repellent device 34 fits in the container receiving section 26 and is held in place by a collar 38 that is integral with handle portion 12 and a set screw 40. The attack repellent device 34 includes an elongated cylindrical body 42. The body 42 is typically a pressurized container including a repellent chemical, such as tear gas, mace, cayenne pepper or some other repellent.

One alternative to using a set screw 40 to hold the container in position is to use mating hook and loop fastening means on the bottom of the container and on the top of the weight in the hollow tube-like structure. The cylindrical body 42 extends from a base end 44 to an actuator end 46. An actuator cap 48 is at the end 46 for manual operation by a user. There are many different containers and contents. The actuator caps are fairly typical.

The cap 50 is rotatably mounted on the cylindrical body 42 and includes a push button dispensing nozzle 52. The nozzle 52 is fitted on cap 50 and is rotatable thereon between a "safe" position, (not shown) where the button cannot be pressed, and an "armed" position (not shown) where the button is rotated about 90 degrees and may be pressed to discharge the contents.

In use, an attack repellent device 34 is placed in container receiving section 26, and set screw 40 is tightened to hold it in place. Alternatively, the aforementioned hook and loop fastening may be used. A selected weight 18 is screwed on end 20. A uses slips his or her hand through handle straps 30 and grips handle portion 12. Should the need arise to use the attack repellent, the cap is rotated to the "armed" position where the cap is pressed and repellent is released.

What is claimed is:

1. A hand exercise weight and attack repellant combination device for use by walkers and joggers comprising:

a handle member having a threaded first end, a container receiving second end, and a resilient outer covering at a central hand gripping portion thereof;

a removable exercise weight having a threaded connection for engaging said threaded first end;

a replaceable attack repellant container for dispensing a repellant agent contained in said container, said container being disposed in said receiving second end and having means for releasing said repellant agent; and a strap attached to said first end and to said second end.

2. A hand exercise weight and attack repellant combination as in claim 1 wherein said handle member is an elongated cylindrical member.

3. A hand exercise weight and attack repellant combination as in claim 2 wherein said handle member has a hollow section which is filled with a lead or other heavy substance to supplement said weight or serve as a second weight, and said handle member being fabricated from a contiguous piece of material.

4. A hand exercise weight and attack repellant combination as in claim 3 wherein said handle member has an integral collar member on said second end and a tightening means on said collar for securing said container in said handle member.

5. A hand exercise weight and attack repellant combination as in claim 1 wherein said container is held in said handle member by mating hook and loop fasteners on said container and said second end.

6. A hand exercise weight and attack repellant combination as in claim 1 wherein said weight is selected from a group of differently sized weights.

* * * * *